United States Patent [19]

Harilainen

[11] Patent Number: 4,702,188

[45] Date of Patent: Oct. 27, 1987

[54] BOTTOM STRUCTURE OF A BOAT

[76] Inventor: Eero Harilainen, Pohjoiskaari 8 A 9, SF-00200 Helsinki, Finland

[21] Appl. No.: 804,686

[22] Filed: Dec. 4, 1985

[30] Foreign Application Priority Data

Dec. 13, 1984 [FI] Finland ..... 844937

[51] Int. Cl.[4] ..... B63B 1/32

[52] U.S. Cl. ..... 114/56; 114/290; 114/291

[58] Field of Search ..... 114/56, 290, 291, 271

[56] References Cited

U.S. PATENT DOCUMENTS

| | | | |
|---|---|---|---|
| 1,024,682 | 4/1912 | Fauber | 114/291 |
| 2,162,705 | 6/1939 | Diehl | 114/291 |
| 2,919,669 | 1/1960 | Kibuhara | 114/290 X |
| 4,409,922 | 10/1983 | Mambretti | 114/56 X |

FOREIGN PATENT DOCUMENTS

| | | |
|---|---|---|
| 750133 | 7/1975 | Finland . |
| 922199 | 3/1963 | United Kingdom . |

OTHER PUBLICATIONS

P. 264 of the book "Suui Venekirja", published by Weilin & Goos, Helsinki, 1978.

*Primary Examiner*—Sherman D. Basinger

*Attorney, Agent, or Firm*—Andrus, Sceales, Starke & Sawall

[57] ABSTRACT

The invention comprises a stepped bottom structure of a boat, in which the steps (5) are mainly straight. The number of the steps is from 2 to 4, preferably 3, and the angle between the mainly straight edge (8) of the step and the keel (1) is from 20° to 60°, preferably from 20° to 45°. In addition, the bottom structure includes rising laths (10), in which the side (19) facing the keel (1) is narrower than the side (20) facing the side of the boat.

6 Claims, 3 Drawing Figures

BOTTOM STRUCTURE OF A BOAT

Figure 1:
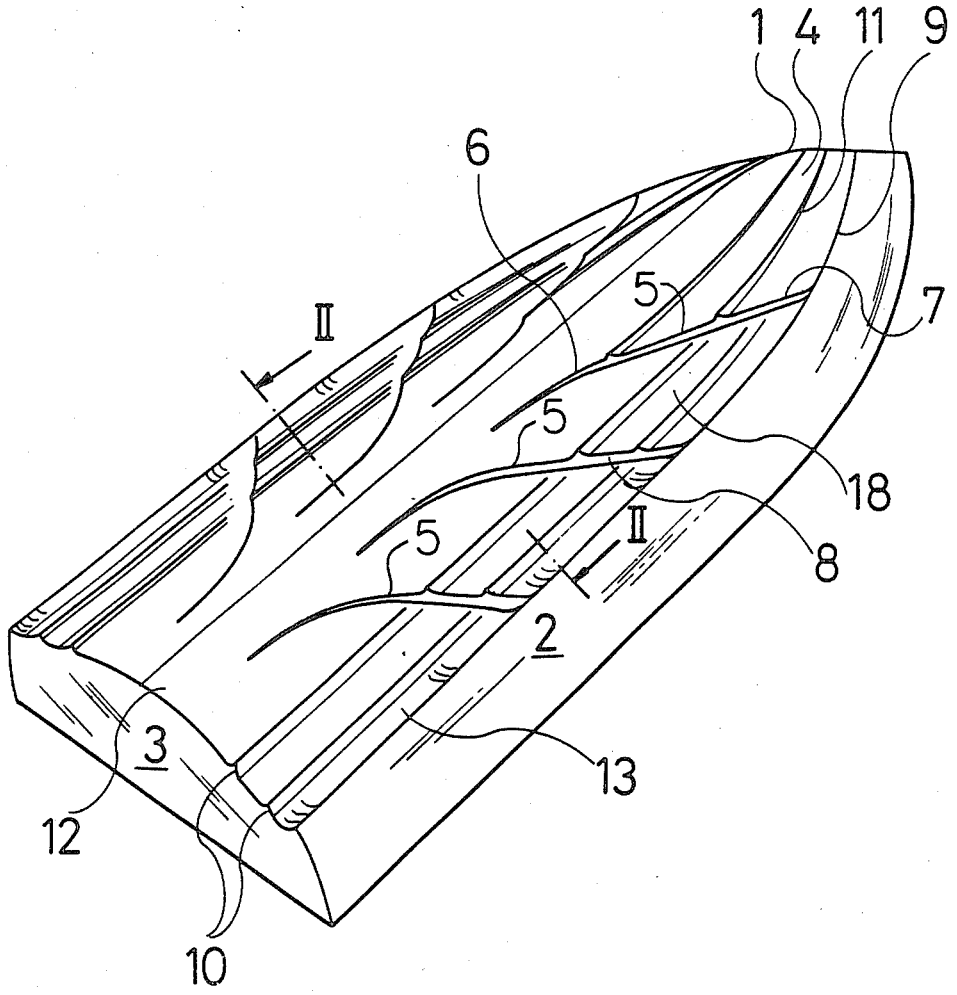

The present invention relates to a bottom structure of a boat.

Transverse steps used in the bottom structures of planing boats, in which the planing surface is formed of two or more parts, in order to minimize the resistance of water, are known. U.S. Pat. No. 3,331,347. Thus the boat, when planing, rises due to the effect of the steps so that the wet surface decreases. The biggest drawback in the bottom structures mentioned above is that the impacts of water are felt hard.

Efforts have been made in order to obviate the effect of the hardness mentioned above by step constructions in V-shaped bottoms, British Pat. No. 922,199, dated Mar. 27, 1963 and Finnish Pat. No. 750,133, dated July 24, 1975. These achieve a certain improvement in the hardness of the boat, which is due to the V-shaped bottom. However, due to the V-shaped bottom the wet surface of the planing boat increases, because the inclination of the hull causes transverse flow and the boat passes deeper in water. The planing features of a boat with a V-shaped bottom including steps are, however, better than in boats having a smooth V-shaped bottom equipment with rising laths. Other drawbacks are the increase in the resistance of water caused by the sideways flow and poor cornering properties caused by the same reason.

The stepped bottom structure brought up in the publication Finnish Pat. No. 750,133 includes several curved steps, in which the angle of the step has been fitted in each part of the bottom according to the presumed flow of water. As the step surfaces are smooth the flow pattern lines of water are curved, at which the steps are formed so that the direction of the flow of water as the boat is planing is essentially perpendicular to as large a portion of the step as possible. This results in a large number of steps and a complicated structure.

The biggest drawback in the bottom forms presented above is the sideways flow of water substantially over the whole length of the hull. This flow causes an increase in the wet surface of the boat. However, a boat can be partly "released" from water by the structures mentioned above, at which the friction decreases and the speed increases, but due to the sideways flow the handling-characteristics and stability of the boat as well as its behaviour in rough waves are poor.

An object of the invention is to obviate the drawbacks mentioned above. Especially the object of the invention is to bring about a bottom structure of a boat which structure has good handling-characteristics in various circumstances, good loading properties and which is economical as well as less power demanding.

The characteristic features of the invention are set forth in the claims.

The invention is based upon the principal that by the right form of the stepped structure and in one adaptation by the use of rising laths the water surging sideways beneath the bottom can be bent back below the bottom to act as a load bearing element by utilizing pressure differences. The stepped structure forms in this case a multiple step accelerator, in which the flowrate of water increases significantly. In using this type of a stepped structure the flow beneath the bottom is aimed to be kept in contact with the bottom and not separated from it as in all previous variations of stepped structures of the bottom. Although, the flow can be maintained essentially in contact with the bottom, vortexes and fizzes, small air bubbles, which decrease the friction between the bottom of the boat and water, are formed near the hull due to the merit of the steps and the effect of the underpressure.

In boats with V-shaped bottoms the flow of water is always away from the keel outwards towards the sides, although, when moving towards the rear the flow turns more into the direction of the keel but not into a direction parallel with the keel.

The number of the steps in the bottom according to the invention is from 2 to 4, preferably 3. In addition, the bottom structure includes preferably rising laths which are not known in connection with previous stepped structures. On both halves of the bottom, 2 to 6 rising laths have been included, preferably 3 to 5.

The rising laths are fitted in "the wrong way" with respect to the prior art i.e. so that the steeper and narrower part of the surface of the lath is on the side of the keel. Thus, the rising laths effectively prevent the water from flowing outwards and the apparent buoyancy of the boat is better.

The mainly straight edges of the steps form angles with the keel line of the boat. These angles vary from 20° to 60° depending upon the type of the boat.

The ends of the steps nearby the keel begin at a small distance apart from the keel so that a mainly smooth area is left on both sides of the keel of the boat. This area doesn't include steps and extends along the whole length of the boat, which prevents cavitation and ensures smooth running for the propeller.

In the described step structure which includes rising laths, the rising laths prevent the water from flowing sideways and the underpressure formed by the step construction in the space behind the step causes the flow of water towards the keel.

In a bottom stepped according to the invention the step is formed so that the end of the step near the keel is mainly parallel to the keel at a distance apart from the keel, and the end near the side of the bottom is mainly parallel to the side and at a distance apart from the side. The distance mentioned above is from 5 to 20% preferably 10% of width of the bottom between the keel line and the edge.

The height of the ends changes evenly from the rear towards the bow of the boat so that the ends begin smoothly from the plane of the base surface and increase evenly in height towards the front and turn circularly in order to form the edge of the step at the front part. The width of the edge of the step changes uniformly from the middle part towards the side of the bottom. In this manner the mainly vertical edge and the ends of the step from an edge of the step structure which rises and decreases evenly. The edge of step is at its highest near the circular point of convergence of the edge and the end near the side of the bottom.

In the bottom structure in accordance with the invention the steps are conveniently formed so that the steps can be imagined as rising upwards from the base surface of the bottom. Thus, as the V-angle at the steps increases towards the side of the bottom the angle of impact increases. Although, the angle of impact increases, it won't cause an increase in the hardness of the bottom, because at the same time the V-angle of the bottom increases, which on the other hand softens the passage of the boat through water.

In an apparatus according to the invention the rising laths curve suitably at the bow of the boat in a direction mainly parallel to the seam line towards the keel line and extend to the keel. In this manner the rising laths direct the bow splashes under the boat and smooth the passage of the boat.

In another adaptation at the point of convergence between the side and the bottom of the hull at the seam line outside the outer ends of the steps has been formed a downwards concave surface or groove which extends through the whole length of the boat. The groove directs the sideways splashes caused by the bottom downwards and thus decreases the amount of flow perpendicular to the keel.

In one adaptation the stepped surfaces are mainly parallel. In another adaptation the stepped surfaces are divergent so that the angle of impact is biggest at the rearmost step and smallest at the step farthest to front.

In one adaptation of the invention the step structure in accordance with the invention has been placed in a sailing boat or other boat with a proper keel. The bottom of the boat according to the invention has also the presented favourable effects upon the properties of boats and ships which have a displacing hull structure.

A change in the flow of water under the bottom of the boat is achieved by the bottom structure according to the invention so that all of the water flows out mainly from the rear of the boat. The sideways flows have been eliminated almost completely. Thus the displacement and passage of the boat in the deep mode is prevented, the wet surface of the bottom decreases substantially and the boat moves easier. The boat becomes almost insensitive even to large variations of loads.

Due to the stepped structure the steps have an effect of triming the boat. As the rear of the boat sinks down the angle of impact increases at the sides, which gives rise to upwards effecting forces. Thus, the boat stays almost in the same position regardless of the load or the waves.

Due to its self trimming property the boat moves always in the most advantageous position and due to the step structure provided with rising laths the wet surface during planing is minimized. Also the splashes directed towards the front and the sides can be eliminated, at which the energy spent on them is saved. Due to these facts the power required from the motor decreases and the speed increases, which makes the boat significantly more economical. The handling properties have been noted in practical tests i.e. the almost complete insensitivity to variations in loads and to waves as well as the stability at full speed in tight cornering.

Figure 3:
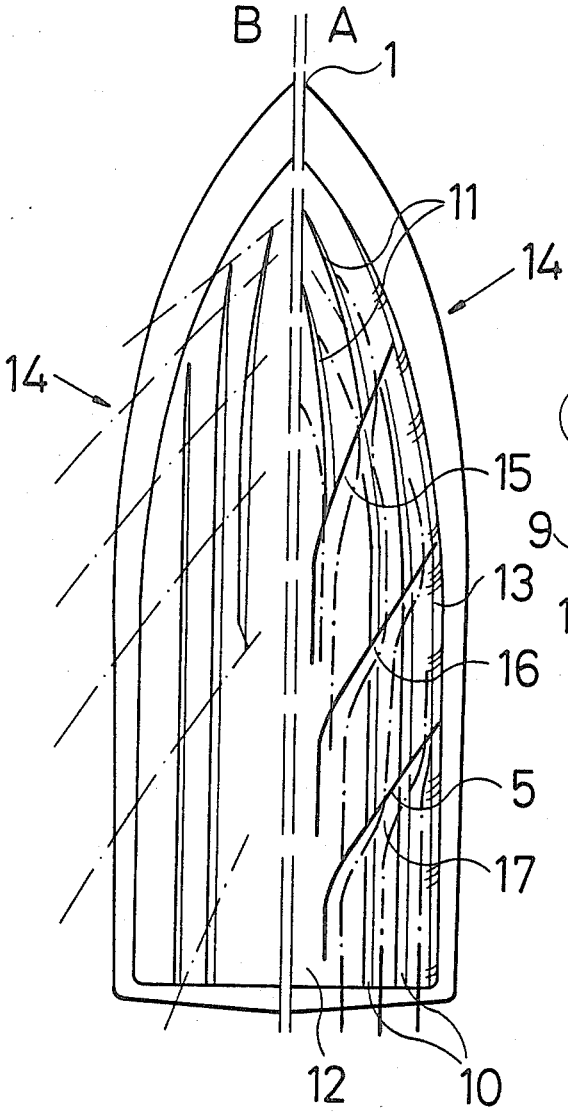
Figure 2:
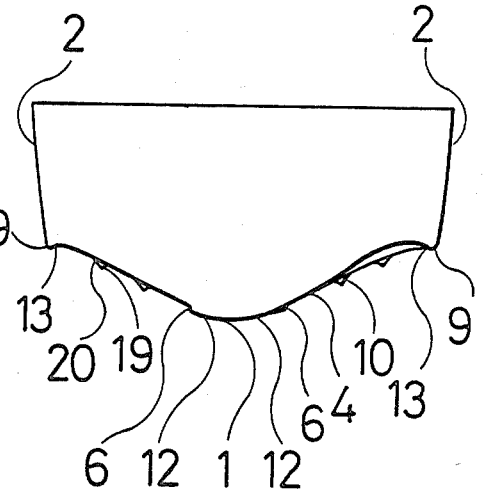

The invention is described in the following by referring to the accompanying drawings, in which FIG. 1 shows a perspective view of an upside down turned boat which has a bottom equipped with steps in accordance with the invention, FIG. 2 shows a sectioned view of the boat of FIG. 1, and FIG. 3 shows the flow of water at the bottom of the boat in accordance with the invention and at a normal V-shaped bottom structure.

The frame of the boat presented in FIG. 1 includes a keel 1, a side 2, a stern 3 and a base surface 4 of the bottom. Steps 5 according to the invention have been formed on the base surface 4. The steps rise from the base surface. The step is formed of a vertical end 6 increasing evenly in height towards the bow, an end 7 near the edge of the side of the bottom and an edge 8 increasing evenly in height from the keel towards the side of the bottom between the ends 6 and 7 as well as of a step surface 18 limited by the ends 6, 7, and edge 8. On the surface of the step 5 two rising laths 10 parallel to each other and the seam line 9 have been attached. The rising laths start from the rear edge of the step i.e. from the previous edge 8 and the rising laths in the rear start from the stern 3. The front part of the rising laths is at a distance apart from the previous edge 8. The front parts of the lateral rising laths 11 curve in a direction parallel to the seam line 9 and end at a distance apart from the keel 1.

Between the steps 5 and the keel 1 a mainly smooth surface 12 of the bottom is left. Between the steps 5 and the seam line 9 is a downwards concave surface or a groove 13.

FIG. 2 shows a view of the bottom structure according to FIG. 1 sectioned along the line II—II. The numbers are the same as in FIG. 1. The rising laths 10 have been formed on the bottom "in the wrong way" i.e. so that the surface 19 which faces the keel 1 is narrower than the surface 20 facing the side 2.

FIG. 3 shows the directions of the flow of water at the bottom of a structure A which is in accordance with the invention as well as the flow of water at a normal V-shaped bottom structure B equiped with rising laths.

At the normal V-shaped structure B the flow of water at the bow of the boat 14 is steeply away from the keel line 1 of the boat and bends towards the keel line in the rear of the boat, but the flow is always away from the keel line.

At the V-shaped bottom structure of the invention A, which structure includes steps 5 as well as rising laths 10, the flow of water is as follows. At the bow 14 of the boat the rising laths 11 farthest to the front direct the front splashes below the boat. The flow impacting on the first step 15 is effected by an underpressure which influences the flow and directs it along the edge of the step towards the keel. A similar flow takes place also at the middle 16 and back 17 steps. Thus, the water beneath the boat is discharged mainly from the rear of the boat. The mainly smooth surface at the middle on both sides of the keel 1 ensures the troublefree running of the propeller. The downwards converging groove 13 directs the splashes reaching towards the sides downwards.

Due to the flow pattern presented above, the boat bears loads well, because the water is compacted below the bottom and won't splash away everywhere from below the bottom. Thus, the water resistance decreases and the boat moves easier. If the step surfaces 18 are divergent, the angle of impact is smallest at the first step 15 and largest at the last step 17. The presented bottom structure controls the planing of the boat so that the most advantageous driving position is achieved. As the load is incereased the angle of impact tends to increase, which gives rise to a counterforce which lifts the boat upwards. Because of this the boat is almost insensitive to changes in loading. According to the same principle the bottom functions also in rough waves and smooths the passage of the boat.

Although, the invention has been explained chiefly with respect to planing boats with V-shaped bottoms, the inventive structure can be as well adapted for use in sailing boats or boats and ships which have a displacing hull structure. The invention is not limited to the examples presented above and its applications can vary within the scope defined by the claims.

I claim:

1. A bottom structure for a boat having a bottom surface extending from a central keel line to the sides of the hull of the boat; said bottom surface having between two and four steps spaced in the fore and aft direction of the hull, each of said steps being formed of a pair of edge surfaces positioned symmetrically on the bottom surface with respect to the keel line; said edge surfaces being generally perpendicular to said bottom surface; each of said edge surfaces having a plurality of contiguous portions including a first portion that is adjacent an inner end of said edge surface; said first portion being straight and generally parallel to, but spaced from, said keel line; said edge surface including a second, bent portion that is convexly bent when viewed from the keel and looking toward the sides of the hull, said edge surface including a third portion extending from said bent portion to an outer end of said step; said convexly bent, second portion being bent through a forwardly diverging angle of between 20° to 60° with the keel line of the boat.

2. A bottom structure according to claim 1 wherein the angle of said bent portion of said edge surfaces is greatest at the aftmost step and smallest at the furthest forward step.

3. A bottom structure according to claim 2 wherein said bottom surface includes a downwardly opening concave foreaft groove extending along the length of the boat adjacent each side of the hull for directing sideways splashes downwardly.

4. The bottom surface according to claim 2 wherein a generally uninterrupted area is formed on both sides of the keel line extending along the entire length of the boat.

5. A bottom structure according to claim 1 wherein said bottom structure is provided with water guide members extending generally from the bow to the stern of the hull.

6. A bottom structure according to claim 5 wherein said guide members are generally triangular in transverse cross sectional configuration and in which the surface facing toward the keel line is smaller than the surface facing toward the side of the hull.

* * * * *